United States Patent [19]

Akiyama et al.

[11] 4,185,533

[45] Jan. 29, 1980

[54] TOY MUSICAL INSTRUMENT

[75] Inventors: Kenzo Akiyama; Masaru Ogihara, both of Tokyo, Japan

[73] Assignee: Tomy Kogyo Co., Inc., Tokyo, Japan

[21] Appl. No.: 959,621

[22] Filed: Nov. 13, 1978

[30] Foreign Application Priority Data

Dec. 28, 1977 [JP] Japan ..... 52-157851[U]

[51] Int. Cl.[2] ..... G10D 9/04; G10F 1/12; G10F 5/06

[52] U.S. Cl. ..... 84/83; 46/178

[58] Field of Search ..... 84/83, 330, 331, 332, 84/333, 334, 340; 46/202, 174, 177–179, 183–187

[56] References Cited

U.S. PATENT DOCUMENTS

| | | |
|---|---|---|
| 1,826,635 | 10/1931 | Prestek . |
| 2,487,413 | 11/1949 | Barnum . |
| 3,908,505 | 9/1975 | Ono . |
| 3,982,459 | 9/1976 | Akiyama . |

*Primary Examiner*—L. T. Hix

*Assistant Examiner*—Benjamin R. Fuller

*Attorney, Agent, or Firm*—Edward D. O'Brian

[57] ABSTRACT

A musical instrument is disclosed which is capable of being operated in either of two different ways—through the use of a rotary record member, or through the manual manipulation of individual keys. The instrument disclosed includes a windchest used to supply air to either of two different principal valves, each of which is capable of being manipulated so as to set up resonance within an associated resonance chamber. Secondary valves are provided for varying the acoustically effective dimensions of the resonating chambers. All of the valves have actuators which extend into an area of the instrument capable of serving as a holder for the record member. When the record member is inserted in this holder and rotated cams on the record member engage the actuators so as to cause the production of a desired series of notes. Keys on the instrument are capable of being manually manipulated so as to cause the movement of levers into engagement with the actuators when no record member is present.

12 Claims, 9 Drawing Figures

TOY MUSICAL INSTRUMENT

BACKGROUND OF THE INVENTION

The invention set forth in this specification pertains to new and improved musical instruments. More specifically it pertains to musical instruments which can either be manually operated or which can be operated through the appropriate utilization of a record-type member.

Throughout the ages a wide variety of different types of musical instruments have been developed and utilized. Such instruments have normally been of either of two different types: a type capable of being manually operated or of a type capable of being automatically operated so that a record member such as, for example, a disk carrying lugs, an elongated sheet provided with holes, or the like, serves to operate the instrument during the movement of a record member. Both types of instruments are considered to have a great deal of relative merit for serious musical purposes as well as for play purposes.

Unfortunately those known prior musical instruments which have been primarily intended for use in the toy field have normally been constructed so as to serve as either manually operated instruments or as automatically operated instruments. This is considered disadvantageous for play value purposes since if a toy instrument is to maintain the attention of a comparatively young child the instrument should preferably have different, separate modes of operation so as to be capable of being used by a child in different ways.

The recognition of the latter is believed to have led to the development of a few limited types of instruments capable of being utilized both manually and automatically. Thus, for example, it has been recognized that various types of hurdy-gurdies or barrel organs could be constructed so as to be operated by the rotation of a cam drum record member and so as to be capable of being manually actuated. Such instrument structures are considered comparatively undesirable for toy purposes because the cam drums employed in them are essentially unchangeable structures in the sense that they cannot be lifted out or replaced with any particular facility or ease.

In theory it should be possible to at least partially remedy this problem by making the cams used with the record member in this type of device adjustable so that a user can periodically reprogram the cams for different songs or melodies. As a practical matter this is considered undesirable in a toy for the simple reason that many small children are substantially incapable of repositioning a series of cams in a precise, desired predetermined manner. Further, a child in playing with a toy of this type, even if possessed of the capability of changing such cams, will not want to go through such an exercise because of the time and energy required.

Another factor has tended to preclude the use of instruments capable of being used manually and automatically in the toy field. This pertains to the relative complexity and the resultant costs of instruments of the type noted. In order for a toy musical instrument to find a widespread utilization it is necessary for such an instrument to be constructed in such a manner as to withstand the normal abuse of children and in such a manner as to be sufficiently inexpensive so that it can be sold at a comparatively nominal price. In a sense these two factors are somewhat contradictory. In general the more resistant a toy is to child abuse the more expensive it is to manufacture the toy. It has long been recognized that a possible solution to such contradiction would be to simplify the construction employed in a particular instrument.

SUMMARY OF THE INVENTION

A broad objective of the present invention is to provide new and improved musical instruments. More specifically the invention is intended to provide new and improved musical instruments which can be either manually operated or manipulated or which can be operated automatically through the utilization of a record-type member. Other objects of the present invention are to provide musical instruments as indicated which are especially desirable for use for toy or play-type purposes, which can be easily and conveniently constructed at a comparatively nominal cost, which are capable of withstanding reasonable physical abuse such as is normally accorded a toy and which are capable of being easily and conveniently utilized for play or other purposes.

Still further objects of the present invention are to provide musical instruments of the type specified which are especially desirable because of the use of a minimum number of valves controlling the operation of two resonating chambers to provide a series or set of eight consecutive notes on the musical scale. A still further objective of the present invention is to provide instruments which are especially desirable in that they utilize separate keys and levers for manual operation in such a manner that these keys and levers are rendered inoperative when the instrument is used with a record or record type member.

In accordance with this invention certain of these objectives are achieved by providing a wind operated musical instrument having a resonating chamber, sound producing means for setting up resonance within this chamber and valve means for varying the acoustically effective dimensions of the chamber depending upon whether the valve means is open or closed in which the improvement comprises: a second resonating chamber in association with the first resonating chamber, a second sound producing means for setting up resonance within the second chamber, a second valve means for varying the acoustically effective dimensions of the second chamber, each of the valve means being capable of being operated to simultaneously vary the acoustically effective dimensions of both of the chambers, both of the chambers and both of the valve means being of such dimension that by separate and concurrent operation of the first and second sound producing means and by separate and concurrent opening and closing of both of the valve means, it is possible to obtain from the instrument eight consecutive notes on the musical scale.

In accordance with this invention certain of the noted objectives are achieved by providing a musical instrument having a holder for a record member, a record member which is capable of being inserted into and taken out of the holder, means for rotating the record member when the record member is located within the holder, note production means for producing a series of notes, movable actuator means for actuating the note production means, and cam means on the record member for actuating successive of the actuator means in order to cause the production of successive notes in which the improvement comprises: a plurality of separate, movable keys, lever means operatively associated with the keys for operating the actuator means, the lever means being responsive to movement of the keys in order to engage and move actuator means, the lever means being located so that when the record member is in the holder the record member physically prevents the lever means from engaging the actuator means.

In an instrument as indicated in the preceding paragraph the note production means used preferably includes two different resonating chambers and associated sound producing means for setting up resonance and associated resonance valve means as indicated by the preceding discussion. It will, of course, be recognized that a variety of sound producing means can be utilized for setting up resonance. With the present invention it is preferred to utilize essentially a conventional organ-type structure for this purpose since such a structure is comparatively simple, effective and capable of withstanding considerable abuse. Other known expedients such as reeds or the like can, of course, be employed.

BRIEF DESCRIPTION OF THE DRAWINGS

Because of the nature of the invention it is best more fully described with reference to the accompanying drawings in which.

Figure 2:
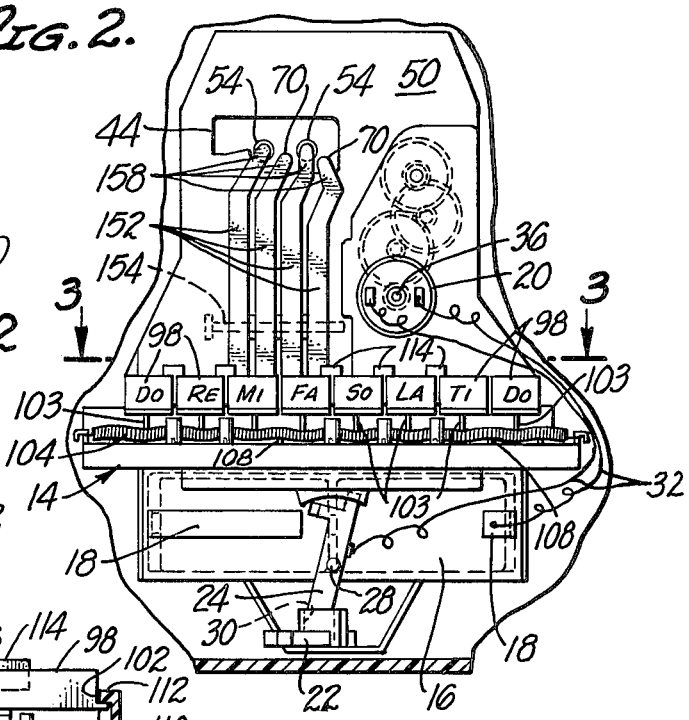
FIG. 2 is a partial cross-sectional view at an enlarged scale taken at line 2—2 of FIG. 1.
Figure 1:
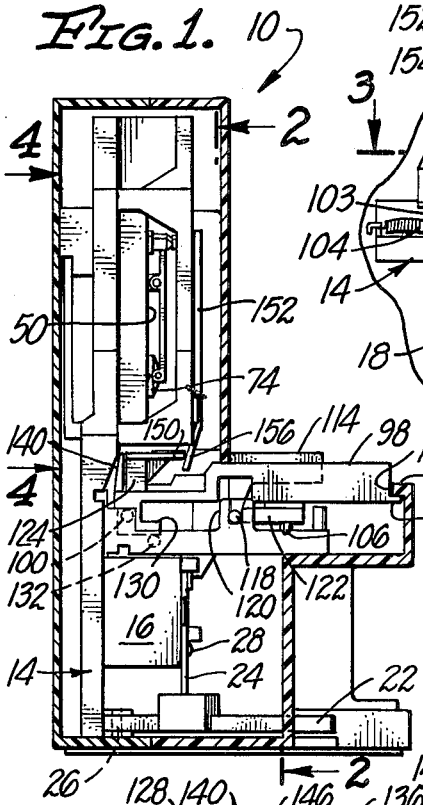
FIG. 1 is a side elevational view of a presently preferred embodiment or form of a musical instrument in accordance with this invention installed within a housing, this housing being shown in section in this figure.

The particular musical instrument illustrated in the drawings is constructed so as to utilize the operative principles or concepts of this invention verbally set forth in the appended claims. It is believed that those skilled in the construction of musical instruments such as are commonly utilized as toys will have little difficulty in applying these concepts or principles so as to create a variety of somewhat differently appearing and somewhat differently constructed musical instruments differing from the precise instrument shown only as to matters of routine design and engineering skill.

DETAILED DESCRIPTION

In the drawings there is shown a toy musical instrument 10 in accordance with this invention which is built into a housing 12 appearing reasonably like a conventional upright piano. This instrument 10 is constructed about an integral, electrically nonconductive, rigid polymer framework 14 located within the housing 12. As subsequently pointed out many portions of this framework 14 serve functional purposes in the complete instrument 10. The framework 14 is constructed so that it and various connected operative parts of the instrument 10 can be assembled as a unit, tested, and then inserted and mounted within the housing 12.

The framework 14 is constructed so as to include a lower elongated battery holder 16 having terminals 18. A switch mechanism (not separately numbered) is provided for the purpose of controlling an electric current supplied to a small electric motor 20. Although any sort of a conventional switch can be employed it is preferred in the instrument 10 to utilize a switch including an electrically nonconductive actuator 22 and a conductive metal lever 24. This actuator 22 is shaped so as to simulate a conventional piano foot pedal and is mounted on the framework 14 by means of a pivot 26. The lever 24 is mounted on the framework 14 by means of another pivot 28 so that it normally extends into a cavity 30 within the actuator 24. With this construction the actuator 22 may be rotated so as to cause rotation of the conductive metal lever 24 into contact with one of the terminals 18. This will close the circuit including wires 32 so that power is supplied to the motor 20.

This motor 20 is mounted upon the framework 14 immediately in front of a cavity 34 serving as a blower housing. The shaft 36 of this motor 20 extends into this cavity 34 where it is attached to an impeller 38. As the impeller 38 is rotated about its axis ambient air is drawn into the cavity 34 through a centrally located opening 40 and is forced under pressure outwardly through a conventional passage 42 located in the framework 14 and thence into a small windchest 44. This windchest 44 is provided with two outlet slit-like openings 46 serving as throats as the instrument 10 is operated.

The windchest 44 is intersected by two separate cylindrical guide passages 48, each of which corresponds to one of the openings 46. These passages 48 extend into the windchest 44 from adjacent to a front wall 50 of the windchest 44. Each of these passages 48 carries a valve stem 52 which is in the nature of a piston and which is capable of being linearly moved within the passage 48 within which it is located. Each of these stems 52 is provided with an actuating end 54 located exteriorly of the windchest 44 adjacent to the wall 50. Each of these stems 52 is also provided with a valve member 56 which overlies and closes off the associated one of the openings 46 when located so as to project outwardly from the front wall 50 to as great an extent as possible.

With this structure air under pressure within the windchest 44 will normally tend to bias the stems 52 so that the actuating ends 54 extend outwardly from the wall 50 to the maximum extent permitted with the construction employed. In this position there is no air flow or substantially no air flow through the openings 46. However, the instrument 10 is capable of being operated so that the actuating ends 54 of the stems 52 may be pushed generally toward the front wall 50 in the windchest 44. This will move the valve members 56 so as to uncover these openings 46. When this occurs, air under pressure will be directed from the openings 46 toward sound producing edges 58 located adjacent to openings or mouths 60 in a conventional manner. This will, of course, cause the production of sound.

Figure 6:
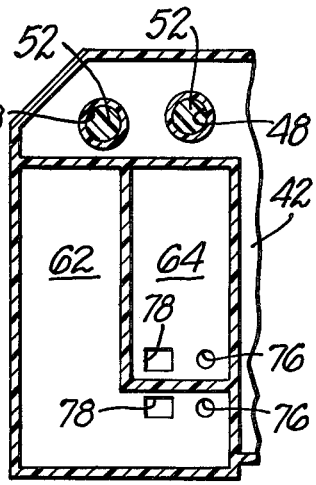
FIG. 6 is a partial cross-sectional view taken at line 6—6 of FIG. 5.

The framework 14 adjacent to the windchest 44 is constructed so as to provide two different integral resonating chambers 62 and 64 which share the wall 50. The chamber 62 is the larger of these two chambers 62 and 64 and extends more or less around the chamber 64 as illustrated in FIG. 6 of the drawing. Each of the chambers 62 and 64 is associated with and in communication with one of the openings 46 and, of course, the edge 58 and the mouth 60 associated with such openings 46 so as to be capable of determining through resonance the sound produced when air passes through its associated opening 46 as a result of movement of a valve member 56.

An important feature of the present invention relates to the fact that two auxiliary controls (as hereinafter indicated) are provided for determining the notes produced by the resonating chambers 62 and 64. These auxiliary controls include two elongated levers 66, each of which is mounted by means of a pivot 68 on the front wall 50. The uppermost ends 70 of the these levers 66 may be referred to as actuating ends and are preferably shaped as the actuating ends 54 previously described. Pivots 72 located at the lowermost ends (not separately numbered) of the levers 66 are used to mount small valve plates or bodies 74 on these levers 66 in such positions that one of these plates 74 is capable of normally covering round holes 76 in both of the chambers 62 and 64 and so that the other of the plates 74 is normally capable of covering rectilinear holes 78 in both of the chambers 62 and 64.

The levers 66 and the plates 74 are preferably constructed as shown so that normally the action of gravity will hold these plates 74 in such a manner that the holes 76 and 78 are covered and closed. Preferably the geometry of the levers 66, the mounting of these levers 66 and the plates 74 is such that regardless of the position of the levers 66 the plates 74 cannot pivot relative to the levers 66 in such a manner as to be incapable of being moved so as to cover the holes 76 and 78, and is such that the holes 76 and 78 are opened and closed substantially simultaneously as the levers 66 are pivoted.

Figure 7:
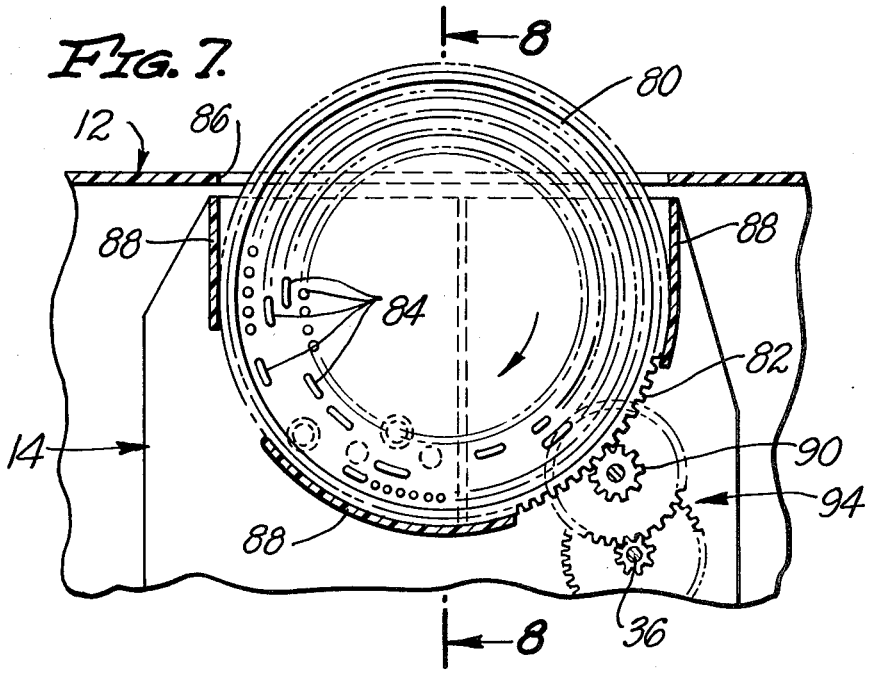
FIG. 7 is a partial cross-sectional view taken at line 7—7 of FIG. 5 with a record member in place in the instrument.
Figure 8:
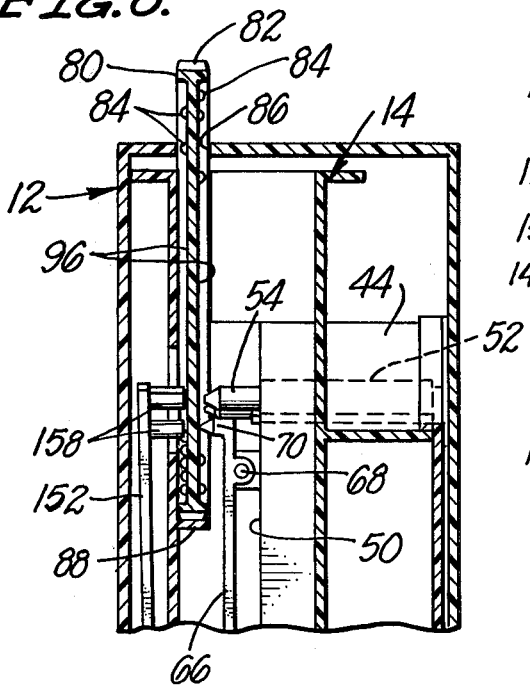
FIG. 8 is a partial cross-sectional view taken at line 8—8 of FIG. 7.
Figure 9:
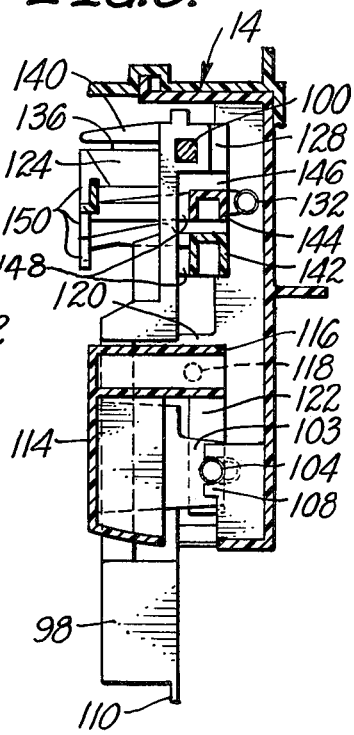
FIG. 9 is an enlarged partial cross-sectional view taken at line 9—9 of FIG. 3.

With the instrument 10 the actuating ends 54 and 70 may be moved in two different manners depending upon the desired mode of operation of this instrument 10. One of these modes of operation involves the use of a disk-like record member 80 as indicated in FIGS. 7 and 8 of the drawing. This record member 80 is constructed so as to include an external ring gear 82 and so as to include a plurality of cam lugs 84 located on at least one of its surfaces (not separately numbered) in such a position that when the record member 80 is inserted through a slot 86 in the housing 12 the record member will rest upon internal walls 88 serving as a holder in such a manner that it can be rotated as indicated by the arrow in FIG. 7.

Such rotation is imparted to the record member 80 by virtue of the ring gear 82 engaging a small spur gear 90 forming a part of a gear train 94 connected to and operated by the shaft 36 of the motor 20. This gear train 94 is, of course, located externally of the cavity 34. During such rotation the cam lugs 84 periodically and sequentially engage the actuating ends 54 and 70 so as to move the valve members 56 and the valve plates 74 in order to determine notes produced by the instrument 10 in accordance with a particular musical composition corresponding to the shape and configuration and location of the individual cam lugs 84. Because of this action the ends 54 and 70 can be referred to as cam followers. It is noted that these cam lugs 84 are preferably located on both surfaces 96 of the record member 80 so that two different musical compositions may be played with a specific record member 80.

In the other mode of operation of the instrument 10 various different simulated piano keys 98 are actuated when no record member 80 is present within the slot 86. These keys 98 are pivotally mounted upon a rod 100 mounted on the framework 14 so as to extend outwardly in order to be exposed generally in the area of an opening 102 in the housing 12. Each of these keys 98 includes a downwardly extending projection 103 normally engaging an elongated tightly wound coil spring 104 mounted upon lugs 106 formed in the framework 14.

This construction serves to resiliently mount the keys 98 so that they can be depressed slightly in order to deform the coil spring 104 in such a manner that the coil spring 104 will automatically tend to return any key 98 depressed back to its initial position. Small supports 108 can be located on the framework 14 immediately adjacent to the keys 98 so as to facilitate the spring 104 remaining substantially linear at all times. The amount that the keys 98 can rotate generally away from the spring 104 is normally limited by lips 110 on these keys 98 engaging a ledge 112 on the housing 12.

In order to simulate the appearance and action of a conventional piano keyboard small auxiliary simulated keys 114 corresponding to those used in playing sharps and flats on a piano keyboard may be formed integrally with an elongated bar 116 extending beneath the keys 98. This bar 116 includes short shafts 118 pivotally carried by upstanding lugs 120 on the framework 14 so that it and the keys 114 may be rotated slightly. An arm 122 on the bar 116 engages the spring 104 in the same manner in which this spring 104 is engaged by the projections 103 for the purpose of biasing the keys 114 to an upward exposed position. Rotation of the keys 114 away from the springs 104 is limited because of contact between the keys 114 and the keys 98.

The keys 98 are used in rotating either or both of two elongated valve levers 124 and 126. The valve lever 124 is located above the keys 98 adjacent to the rod 100 toward the left as viewed in FIG. 3 while the valve lever 126 is located above the keys 98 adjacent to the rod 100 generally toward the right as viewed in FIG. 3 of the drawing. Both of these levers 124 and 126 are provided with legs 128 pivotally mounted on the rod 100 and with downwardly extending extensions 130. These extensions 130 normally rest against another spring 132 corresponding to the spring 104.

This spring 132 is mounted upon lugs 134 on the framework 14 parallel to the rod 100 and beneath the keys 98. This spring 132 serves to normally bias the valve levers 124 and 126 into what may be referred to as an upward position. In this upward position rear edges 136 and 138 on the levers 124 and 126, respectively, are located immediately adjacent to upstanding pusher rods 140 formed integrally with the keys 98. This structure enables certain of the keys 98 as hereinafter indicated to be pushed downwardly so as to cause the valve levers 124 and 126 to be rotated a comparatively slight amount.

Secondary valve levers 142 and 144 are located generally underneath the keys 98 so as to extend parallel to each other and parallel to the rod 100 so as to be supported by the spring 132. These levers 142 and 144 are provided with legs 146 pivotally mounted upon the rod 100. These levers 142 and 144 are also provided with upwardly extending walls 148 extend to immediately adjacent to keys 98. This structure of the levers 142 and 144 permits various keys 98 to be depressed so as to depress the levers 142 and 144 against the spring 132. As this occurs pusher rods 150 on the levers 142 and 144 corresponding to the rods 140 are moved in the same manner in which the rods 140 are moved. After the levers 142 and 144 have been depressed and released the spring 132 automatically tends to move them back to their initial position.

The pusher rods 140 and 150 are located so as to be capable of pivoting actuating levers 152 which are pivotally mounted on a rod 154 supported on the framework 14. These levers 152 have lower ends 156 which are normally located by gravity immediately adjacent to the rods 140 and 150 in positions such that each lower end 156 is capable of being moved by one of these rods 140 or 150. The levers 152 are provided with elongated actuating ends or pushers 158 which extend generally toward the actuating ends 54 and 70 previously described. The levers 152 are proportioned (relative to the rod 154) so that the action of gravity normally holds the ends 158 away from the ends 54 and 70 so as to permit insertion of a record member 80. However, the levers 152 can be pivoted as a result of movement of keys 98 so as to bring the ends 158 against the actuating ends 54 and 70 during the use of the complete instrument 10.

The manner in which this instrument 10 may be manually manipulated is considered quite important because the instrument 10 utilizes two resonating chambers 62 and 64 previously described, each of which is associated with a single valve member 56 and each of which is associated with a single valve plate 74 in order to obtain the conventional notes do, re, mi, fa, so, la, ti, do of the conventional Occidental musical scale. These notes are indicated on the keys 98 in FIG. 3.

As an aid to understanding the invention it is considered that it is desirable to indicate the specific notes which are produced by the instrument 10 during the utilization of this instrument. During one mode of operation of the instrument these notes are produced as the result of the cam lugs 84 on a record member 80 engaging actuating ends 54 and 70. In the other manual mode of operating the instrument 10 by the manipulation of the keys 98 these same notes are produced as the result or consequence of the movement of the keys 98 so as to cause the levers 124, 126, 142, and 144 to move various actuating levers 152 against the actuating ends 54 and 70 in the same manner in which these actuating ends 54 and 70 are engaged and moved by the cam lugs 84 on a record member 80.

It will, of course, be recognized from the preceding description that engagement of an actuating end 54 will result in the opening of the corresponding valve member 56 and, depending upon the end 54 engaged, this will result in resonance in either the chamber 62 or the chamber 64. It will also be realized from the preceding that the engagement of an actuating end 70 will result in either the round holes 76 being opened or the square holes 78 being opened. The resonance within a resonating chamber 62 or 64 producing a specific note will depend upon whether both the round and the square holes 76 and 78 in such chamber are closed or whether either or both of these holes 76 and 78 in such chamber are open.

Because of this it is considered that it is easiest to explain the notes indicated on the keys 98 with reference to when there is resonance in the chambers 62 and 64 as a result of an appropriate valve member 56 being opened and with reference to the specific holes 76 and 78 in each such chamber being covered or uncovered.

When the note "do" at the low end of the musical scale is produced there is resonance only in the chamber 64 and both of the holes 76 and 78 are closed. When the note "re" is being produced there is resonance only within the chamber 62; the holes 76 are open and the holes 78 are closed. When the note "me" is being produced there is resonance only in the chamber 62; the square holes 78 in both chambers are open while the round holes 76 in both chambers 62 and 64 are closed. When the note "fa" is being produced there is resonance only in the chamber 62 and both the round and square holes 76 and 78 in both chambers 62 and 64 are open.

When the note "so" is being produced there is resonance only within the chamber 64 and the holes 76 and 78 in both chambers 62 and 64 are closed. When the note "la" is being produced there is resonance only with the chamber 64 and the round holes 76 in both chambers 62 and 64 are open while the square holes in both chambers 62 and 64 are closed. When the note "ti" is being produced there is resonance only within the chamber 64 and the square holes 78 in both chambers 62 and 64 are open while the round holes 76 in both chambers are closed. When the note "do" at the high end of the scale is being produced there is resonance only within the chamber 64 and the holes 76 and 78 in both chambers 62 and 64 are open.

It is considered important that in spite of the simplicity of the instrument 10 that this instrument 10 can be used to produce a number of sets or pairs of notes which are in consonance with one another. Such a set consists of the notes "do" and "so" which are produced when there is resonance in both of the chambers 62 and 64 and when all of the holes 76 and 78 are closed. Another such set consists of the notes "re" and "la" produced when there is resonance in both of the chambers 62 and 64 and when the round holes 78 are open while the square holes 78 are closed. Another set consists of the notes "mi" and "ti" produced when there is resonance in both of the chambers 62 and 64 and when the holes 78 are open and the holes 76 are closed. A fourth set consists of the notes "fa" and "do" produced when there is resonance in both of the chambers 62 and 64 and when all of the holes 76 and 78 are open.

Figure 3:
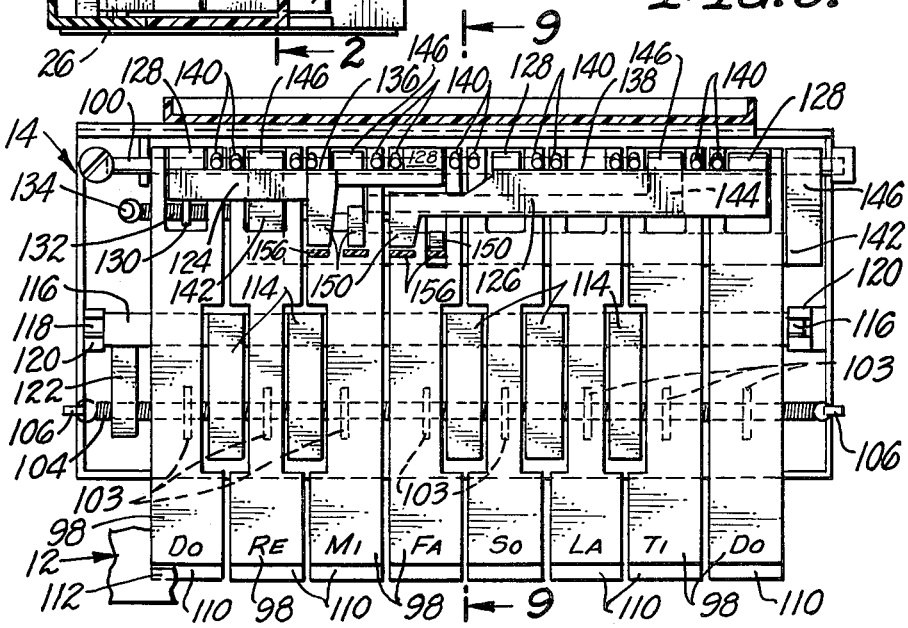
FIG. 3 is a cross-sectional view taken at line 3—3 of FIG. 2.
Figure 4:
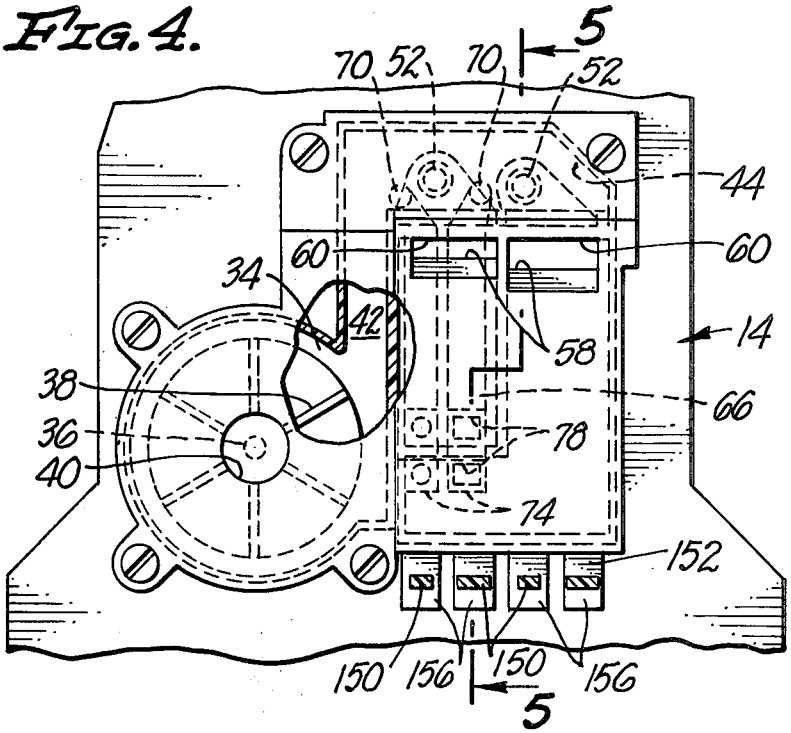
FIG. 4 is a partial cross-sectional view at an enlarged scale taken at line 4—4 of FIG. 1.
Figure 5:
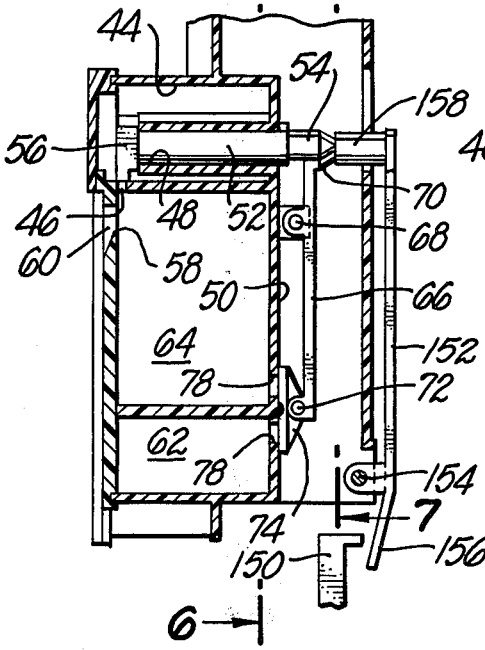
FIG. 5 is a partial cross-sectional view taken at line 5—5 of FIG. 4.

It is believed it will be apparent from the preceding discussion that the keys 98 marked in FIG. 3 of the drawing as "do," "re," "mi" and "fa" are capable of being manipulated so as to cause movement of a lever 124 which in turn will cause movement of a lever 152 serving to engage an actuating end 54 to move an associated valve member 56 in order to cause resonance in order to permit air flow to cause resonance in the chamber 62. The keys marked "so," "la," "ti" and "do" toward the right of FIG. 3 when manipulated cause movement of the lever 126 against a lever 152 so as to cause the actuated lever 152 to engage an actuating end 54 to move a valve member 56 so that air flows so as to cause resonance within the other chamber 64.

With the described structure when the keys 98 labled "re", "fa", "la" and "do" are manipulated in addition to the action achieved in the preceding the lever 142 will be rotated so as to cause movement of a lever 152 sufficient to cause movement of a valve plate 74 in order to open the round holes 76. In a similar manner when the keys marked "mi", "fa", "la" and "do" in FIG. 3 of the drawing are actuated the lever 144 will be moved a sufficient extent so as to engage another lever 152 against an actuating end 70 so as to cause movement of a valve plate 74 in order to uncover the square holes 78.

This mode of operation involves the use of a single movement in one direction of a key 98 so as to cause manipulation of a single principal valve—i.e., a valve member 56 and its associated structure—and, in the case of most of the notes, manipulation and opening of a secondary or resonance control valve—a valve plate 74 and the associated structure involving the holes 76 and 78. Such secondary valves serve only to control the notes produced as a result of resonance within a chamber 62 or 64 by varying the acoustically effective dimensions of the chambers 62 and 64, and in effect, a single valve is used in controlling the existence of resonance of both of the chambers 62 and 64. This simplifies the number of parts required in the instrument 10.

This instrument 10 is considered a very desirable, effective, inexpensive toy instrument having significant play value in that it has two different modes of operation as described in the preceding. Obviously various modifications and changes made within this instrument 10 can be used with the exercise of routine engineering skill.

We claim:

1. In a musical instrument having a resonating chamber, sound producing means for setting up resonance within said chamber and valve means for varying the acoustically effective dimensions of said chamber depending upon whether said valve means is open or closed the improvement which comprises:

a second resonating chamber in association with said first resonating chamber, a second sound producing means for setting up resonance within said second chamber, a second valve means for varying the acoustically effective dimensions of said second chamber, each of said valve means being capable of being operated to simultaneously vary the acoustically effective dimensions of both of said chambers, both of said chambers and both of said valve means being of such dimension that by separate and concurrent operation of said first and second sound producing means and by separate and concurrent opening and closing of both of said valve means it is possible to obtain from said musical instrument eight consecutive notes on a musical scale.

2. A musical instrument as claimed in claim 1 wherein:

each of said valve means includes an opening into said first resonating chamber and an opening into said second resonating chamber, and a movable valve body capable of being moved so as to open and close both of said openings.

3. A musical instrument as claimed in claim 2 wherein:

each of said valve means also includes a pivotally mounted lever and a plate serving as said valve body, said plate being carried by said lever and being capable of opening and closing both of said openings substantially simultaneously.

4. A musical instrument as claimed in claim 1 wherein:

both of said sound producing means comprise a windchest, two separate principal valves for controlling the flow of air from said windchest, a throat means, an associated sound producing edge and a mouth means, each of said throat means, sound producing edges and mouth means being in communication with one of said resonating chambers.

5. A musical instrument as claimed in claim 4 wherein:

each of said valve means includes an opening into said first resonating chamber and an opening into said second resonating chamber, and a movable valve body capable of being moved so as to open and close both of said openings, each of said valve means also includes a pivotally mounted lever and a plate serving as said valve body, said plate being carried by said lever and being capable of opening and closing both of said openings substantially simultaneously.

6. In a musical instrument having a holder for a record member, a record member which is capable of being inserted into and taken out of said holder, means for rotating said record member when said record member is located within said holder, note production means for producing a series of notes, movable actuator means for actuating said note production means and cam means on said record member for actuating successive of said actuator means in order to cause the production of successive notes the improvement which comprises:

a plurality of separate movable keys, lever means operatively associated with said keys for operating said actuator means, said lever means being responsive to movement of said keys in order to engage and move said actuator means, said lever means being located so that when a record member is in said holder said record member physically prevents said lever means from engaging said actuator means.

7. A musical instrument as claimed in claim 6 wherein:

said note production means comprises organ means including a windchest, principal valve means for controlling air passing from said windchest, resonating chamber means and secondary valve means for controlling the note produced by resonance within said resonating chamber means, said actuator means comprise members extending from and connected to movable portions of said principal and said secondary valves.

8. A musical instrument as claimed in claim 7 wherein:

said principal valve means comprise two separate valves, said resonating chamber means comprises two separate resonating chambers, each of which is in communication with one of said principal valves, said secondary valve means comprises two secondary valves, each of which is capable of being actuated so as to open and close an opening in each of said resonating chambers.

9. A musical instrument as claimed in claim 6 wherein:

said note production means is capable of producing a greater number of notes than the number of said actuator means, there are a number of said actuator means, said actuator means being capable of being operated singly and in combination with one another, there is one of said keys corresponding to each of said notes, the number of said lever means is the same as the number of said actuator means, each of said keys includes pusher means for engaging at least one of said lever means so that each time one of said keys is moved at least one of said lever means is moved so as to operate at least one of said actuator means.

10. A musical instrument as claimed in claim 9 wherein:

each of said lever means includes a valve lever and an associated actuating lever, said valve levers being located adjacent to said keys so as to be moved in response to movement of certain of said keys, each of said actuating levers being located adjacent to each valve lever so as to be moved in response to movement of its associated valve lever, each of said actuating levers normally being spaced from the interior of said holder so as to permit a record member to be inserted within said holder, said actuating levers being capable of extending through said holder so as to engage and operate said actuator means when said keys are moved.

11. A musical instrument as claimed in claim 6 wherein:

a plurality of separate movable keys, lever means operatively associated with said keys for operating said actuator means, said lever means being responsive to movement of said keys in order to engage and move said actuator means, said lever means being located so that when a record member is in said holder said record member physically prevents said lever means from engaging said actuator means, said note production means comprises organ means including a windchest, principal valve means for controlling air passing from said windchest, resonating chamber means and secondary valve means for controlling the note produced by resonance within said resonating chamber means, said actuator means comprise members extending from and connected to movable portions of said principal and said secondary valves, said principal valve means comprise two separate valves, said resonating chamber means comprises two separate resonating chambers, each of which is in communication with one of said principal valves, said secondary valve means comprises two secondary valves, each of which is capable of being actuated so as to open and close an opening in each of said resonating chambers, said note production means is capable of producing a greater number of notes than the number of said actuator means, there are a number of said actuator means, said actuator means being capable of being operated singly and in combination with one another, there is one of said keys corresponding to each of said notes, the number of said lever means is the same as the number of said actuating means, each of said keys includes pusher means for engaging at least one of said lever means so that each time one of said keys is moved at least one of said lever means is moved so as to operate at least one of said actuator means, each of said lever means includes a valve lever and an associated actuating lever, said valve levers being located adjacent to said keys so as to be moved in response to movement of certain of said keys, each of said actuating levers being located adjacent to each valve lever so as to be moved in response to movement of its associated valve lever, each of said actuating levers normally being spaced from the interior of said holder so as to permit a record member to be inserted within said holder, said actuating levers being capable of extending through said holder so as to engage and operate said actuator means when said keys are moved.

12. A musical instrument having note production means for producing a series of notes, a series of movable actuator means for actuating said note production means so as to cause the production of notes and a series of movable keys for moving said movable actuator means in which the improvement comprises:

the number of notes capable of being produced by said note production means corresponding to the number of said keys and being greater than the number of said actuator means, said keys being capable of being operated separately from one another, a plurality of mechanical means for transmitting motion from said keys to said actuator means, and for simultaneously operating one or more of said actuator means, each of said keys including pusher means for engaging one or more of said mechanical means so that each time one of said keys is moved at least one of said actuating means is operated.

* * * * *